US011242613B2

(12) United States Patent
Lomasney

(10) Patent No.: US 11,242,613 B2
(45) Date of Patent: Feb. 8, 2022

(54) ELECTRODEPOSITED, NANOLAMINATE COATINGS AND CLADDINGS FOR CORROSION PROTECTION

(71) Applicant: MODUMETAL, INC., Seattle, WA (US)

(72) Inventor: Christina A. Lomasney, Seattle, WA (US)

(73) Assignee: MODUMETAL, INC., Snohomish, WA (US)

( * ) Notice: Subject to any disclaimer, the term of this patent is extended or adjusted under 35 U.S.C. 154(b) by 0 days.

(21) Appl. No.: 16/726,079

(22) Filed: Dec. 23, 2019

(65) Prior Publication Data

US 2020/0318245 A1 Oct. 8, 2020

Related U.S. Application Data

(60) Division of application No. 14/729,020, filed on Jun. 2, 2015, now Pat. No. 10,544,510, which is a division of application No. 13/314,948, filed on Dec. 8, 2011, now Pat. No. 10,253,419, which is a continuation of application No. PCT/US2010/037856, filed on Jun. 8, 2010.

(60) Provisional application No. 61/185,020, filed on Jun. 8, 2009.

(51) Int. Cl.

| | |
|---|---|
| ***C25D 5/14*** | (2006.01) |
| ***C25D 5/18*** | (2006.01) |
| ***C25D 5/00*** | (2006.01) |
| ***C25D 5/10*** | (2006.01) |
| ***C25D 15/00*** | (2006.01) |
| ***C23F 17/00*** | (2006.01) |

(52) U.S. Cl.

CPC ..... *C25D 5/605* (2020.08); *C23F 17/00* (2013.01); *C25D 5/10* (2013.01); *C25D 5/14* (2013.01); *C25D 5/18* (2013.01); *C25D 15/00* (2013.01); *Y10T 428/12493* (2015.01)

(58) Field of Classification Search

None

See application file for complete search history.

(56) References Cited

U.S. PATENT DOCUMENTS

| | | | |
|---|---|---|---|
| 2,428,033 | A | 9/1947 | Nachtman |
| 2,436,316 | A | 2/1948 | Lum et al. |
| 2,470,775 | A | 5/1949 | Jemstedt et al. |
| 2,558,090 | A | 6/1951 | Jemstedt |

(Continued)

FOREIGN PATENT DOCUMENTS

| | | | |
|---|---|---|---|
| CN | 1236024 | A | 11/1999 |
| CN | 1380446 | A | 11/2002 |

(Continued)

OTHER PUBLICATIONS

U.S. Appl. No. 16/582,931, filed Sep. 25, 2019.

(Continued)

*Primary Examiner* — Adam Krupicka

(74) *Attorney, Agent, or Firm* — Seed Intellectual Property Law Group LLP

(57) ABSTRACT

Described herein are electrodeposited corrosion-resistant multilayer coating and claddings that comprises multiple nanoscale layers that periodically vary in electrodeposited species or electrodeposited microstructures. The coatings may comprise electrodeposited metals, ceramics, polymers or combinations thereof. Also described herein are methods for preparation of the coatings and claddings.

17 Claims, 1 Drawing Sheet

(56) References Cited

U.S. PATENT DOCUMENTS 2,642,654 A 6/1953 Ahrens
2,678,909 A 5/1954 Jemstedt et al.
2,694,743 A 11/1954 Ruskin et al.
2,706,170 A 4/1955 Marchese
2,891,309 A 6/1959 Fenster
3,090,733 A 5/1963 Brown
3,255,781 A 6/1966 Gillespie, Jr.
3,282,810 A 11/1966 Odekerken
3,359,469 A 12/1967 Levy et al.
3,362,851 A 1/1968 Dunster
3,483,113 A 12/1969 Carter
3,549,505 A 12/1970 Hanusa
3,616,286 A 10/1971 Aylward et al.
3,633,520 A 1/1972 Stiglich, Jr.
3,716,464 A 2/1973 Kovac et al.
3,753,664 A 8/1973 Klingenmaier et al.
3,759,799 A 9/1973 Reinke
3,787,244 A 1/1974 Schulmeister et al.
3,866,289 A 2/1975 Brown et al.
3,941,674 A 5/1976 Vanmunster
3,994,694 A 11/1976 Clauss et al.
3,996,114 A 12/1976 Ehrsam
4,053,371 A 10/1977 Towsley
4,105,526 A 8/1978 Lewellen, Jr. et al.
4,107,003 A 8/1978 Anselrode
4,191,617 A 3/1980 Hurley et al.
4,204,918 A 5/1980 McIntyre et al.
4,216,272 A 8/1980 Clauss
4,246,057 A 1/1981 Janowski et al.
4,284,688 A 8/1981 Stücheli et al.
4,314,893 A 2/1982 Clauss
4,405,427 A 9/1983 Byrd
4,422,907 A 12/1983 Birkmaier et al.
4,461,680 A 7/1984 Lashmore
4,464,232 A 8/1984 Wakano et al.
4,510,209 A 4/1985 Hada et al.
4,519,878 A 5/1985 Hara et al.
4,540,472 A 9/1985 Johnson et al.
4,543,300 A 9/1985 Hara et al.
4,543,803 A 10/1985 Keyasko
4,591,418 A 5/1986 Snyder
4,592,808 A 6/1986 Doubt
4,597,836 A 7/1986 Schaer et al.
4,613,388 A 9/1986 Walter et al.
4,620,661 A 11/1986 Slatterly
4,652,348 A 3/1987 Yahalom et al.
4,666,567 A 5/1987 Loch
4,670,356 A 6/1987 Sato et al.
4,678,552 A 7/1987 Chen
4,678,721 A 7/1987 den Broeder et al.
4,702,802 A 10/1987 Umino et al.
H543 H 11/1988 Chen et al.
4,795,735 A 1/1989 Uiu et al.
4,834,845 A 5/1989 Muko et al.
4,839,214 A 6/1989 Oda et al.
4,869,971 A 9/1989 Nee et al.
4,885,215 A 12/1989 Yoshioka et al.
4,904,542 A 2/1990 Mroczkowski
4,904,543 A 2/1990 Sakakima et al.
4,923,574 A 5/1990 Cohen
4,975,337 A 12/1990 Hyner et al.
5,043,230 A 8/1991 Jagannathan et al.
5,045,356 A 9/1991 Uemura et al.
5,056,936 A 10/1991 Mahrus et al.
5,059,493 A 10/1991 Takahata
5,073,237 A 12/1991 Bacher et al.
5,079,039 A 1/1992 Heraud et al.
5,156,729 A 10/1992 Mahrus et al.
5,156,899 A 10/1992 Kistrup et al.
5,158,653 A 10/1992 Lashmore et al.
5,190,637 A 3/1993 Guckel
5,228,967 A 7/1993 Crites et al.
5,268,235 A 12/1993 Lashmore et al.
5,300,165 A 4/1994 Sugikawa
5,320,719 A 6/1994 Lasbmore et al.
5,326,454 A 7/1994 Engelhaupt
5,352,266 A 10/1994 Erb et al.
5,378,583 A 1/1995 Guckel et al.
5,413,874 A 5/1995 Moysan, III et al.
5,431,800 A 7/1995 Kirchhoff et al.
5,461,769 A 10/1995 McGregor
5,472,795 A 12/1995 Atita
5,489,488 A 2/1996 Asai et al.
5,500,600 A 3/1996 Moyes
5,547,096 A 4/1996 Kleyn
5,527,445 A 6/1996 Palumbo
5,545,435 A 8/1996 Steffier
5,620,800 A 4/1997 De Leeuw et al.
5,660,704 A 8/1997 Murase
5,679,232 A 10/1997 Fedor et al.
5,738,951 A 4/1998 Goujard et al.
5,742,471 A 4/1998 Barbee, Jr. et al.
5,775,402 A 7/1998 Sachs et al.
5,783,259 A 7/1998 McDonald
5,798,033 A 8/1998 Uemiya et al.
5,800,930 A 9/1998 Chen et al.
5,828,526 A 10/1998 Kagawa et al.
5,912,069 A 6/1999 Yializis et al.
5,930,085 A 7/1999 Kitade et al.
5,942,096 A 8/1999 Ruzicka et al.
5,952,111 A 9/1999 Sugg et al.
5,958,604 A 9/1999 Riabkov et al.
6,036,832 A 3/2000 Knol et al.
6,036,833 A 3/2000 Tang et al.
6,071,398 A 6/2000 Martin et al.
6,143,424 A 11/2000 Jonte et al.
6,143,430 A 11/2000 Miyasaka et al.
6,193,858 B1 2/2001 Hradil et al.
6,200,452 B1 3/2001 Angelini
6,203,936 B1 3/2001 Cisar et al.
6,212,078 B1 4/2001 Hunt et al.
6,214,473 B1 4/2001 Hunt et al.
6,284,357 B1 9/2001 Lackey et al.
6,312,579 B1 11/2001 Bank et al.
6,344,123 B1 2/2002 Bhatnagar
6,355,153 B1 3/2002 Uzoh et al.
6,398,937 B1 6/2002 Menini et al.
6,409,907 B1 6/2002 Braun et al.
6,415,942 B1 7/2002 Fenton et al.
6,461,678 B1 10/2002 Chen et al.
6,466,417 B1 10/2002 Gill
6,468,672 B1 10/2002 Donovan, III et al.
6,482,298 B1 11/2002 Bhatnagar
6,537,683 B1 3/2003 Staschko et al.
6,547,944 B2 4/2003 Schreiber et al.
6,592,739 B1 7/2003 Sonoda et al.
6,725,916 B2 4/2004 Gray et al.
6,739,028 B2 5/2004 Sievenpiper et al.
6,777,831 B2 8/2004 Gutiérrez, Jr. et al.
6,800,121 B2 10/2004 Shahin
6,884,499 B2 4/2005 Penich et al.
6,902,827 B2 6/2005 Kelly et al.
6,908,667 B2 6/2005 Christ et al.
6,923,898 B2 8/2005 Yoshimura et al.
6,979,490 B2 12/2005 Steffier
7,581,933 B2 9/2009 Bruce et al.
7,632,590 B2 12/2009 Punsalan et al.
7,736,753 B2 6/2010 Deligianni et al.
8,084,564 B2 12/2011 Kano et al.
8,152,985 B2 4/2012 Macary
8,177,945 B2 5/2012 Arvin et al.
8,192,608 B2 6/2012 Matthews
8,253,035 B2 8/2012 Matsumoto
8,585,875 B2 11/2013 Cummings et al.
8,814,437 B2 8/2014 Braun
8,916,001 B2 12/2014 Pryce Lewis et al.
9,005,420 B2 4/2015 Tomantschger et al.
9,056,405 B2 6/2015 Sato et al.
9,080,692 B2 7/2015 Tomomori et al.
9,108,506 B2 8/2015 Whitaker et al.
9,115,439 B2 8/2015 Whitaker
9,234,294 B2 1/2016 Whitaker et al.
9,273,932 B2 3/2016 Whitaker et al.
9,732,433 B2 8/2017 Caldwell et al.

(56) References Cited

U.S. PATENT DOCUMENTS

| | | | |
|---|---|---|---|
| 9,758,891 | B2 | 9/2017 | Bao |
| 9,783,907 | B2 | 10/2017 | Cai et al. |
| 9,938,629 | B2 | 4/2018 | Whitaker et al. |
| 10,041,185 | B2 | 8/2018 | Sukenari |
| 10,253,419 | B2 | 4/2019 | Lomasney |
| 10,266,957 | B2 | 4/2019 | Sugawara et al. |
| 10,472,727 | B2 | 11/2019 | Lomasney |
| 10,513,791 | B2 | 12/2019 | Lomasney et al. |
| 10,544,510 | B2 | 1/2020 | Lomasney |
| 10,662,542 | B2 | 5/2020 | Caldwell et al. |
| 10,689,773 | B2 | 6/2020 | Whitaker et al. |
| 10,781,524 | B2 | 9/2020 | Whitaker et al. |
| 10,808,322 | B2 | 10/2020 | Whitaker et al. |
| 10,844,504 | B2 | 11/2020 | Sklar |
| 10,851,464 | B1 | 12/2020 | Kobayashi et al. |
| 10,961,635 | B2 | 3/2021 | Whitaker |
| 11,118,280 | B2 | 9/2021 | Lomasney et al. |
| 2001/0037944 | A1 | 11/2001 | Sanada et al. |
| 2002/0011419 | A1 | 1/2002 | Arao et al. |
| 2002/0070118 | A1 | 6/2002 | Schreiber et al. |
| 2002/0100858 | A1 | 8/2002 | Weber |
| 2002/0179449 | A1 | 12/2002 | Domeier et al. |
| 2003/0134142 | A1 | 7/2003 | Ivey et al. |
| 2003/0234181 | A1 | 12/2003 | Palumbo |
| 2003/0236163 | A1 | 12/2003 | Chaturvedi et al. |
| 2004/0027715 | A1 | 2/2004 | Hixson-Goldsmith et al. |
| 2004/0031691 | A1 | 2/2004 | Kelly et al. |
| 2004/0067314 | A1 | 4/2004 | Joshi et al. |
| 2004/0154925 | A1 | 8/2004 | Podlaha et al. |
| 2004/0178076 | A1 | 9/2004 | Stonas et al. |
| 2004/0211672 | A1 | 10/2004 | Ishigami et al. |
| 2004/0232005 | A1 | 11/2004 | Hubel |
| 2004/0234683 | A1 | 11/2004 | Tanaka et al. |
| 2004/0239836 | A1 | 12/2004 | Chase |
| 2005/0002228 | A1 | 1/2005 | Dieny et al. |
| 2005/0109433 | A1 | 5/2005 | Danger et al. |
| 2005/0205425 | A1 | 9/2005 | Palumbo et al. |
| 2005/0221100 | A1 | 10/2005 | Kirihara et al. |
| 2005/0279640 | A1 | 12/2005 | Shimoyama et al. |
| 2006/0065533 | A1 | 3/2006 | Inoue et al. |
| 2006/0135281 | A1 | 6/2006 | Palumbo et al. |
| 2006/0135282 | A1 | 6/2006 | Palumbo et al. |
| 2006/0201817 | A1 | 9/2006 | Guggemos et al. |
| 2006/0243597 | A1 | 11/2006 | Matefi-Tempfli et al. |
| 2006/0269770 | A1 | 11/2006 | Cox et al. |
| 2006/0272949 | A1 | 12/2006 | Detor et al. |
| 2006/0286348 | A1 | 12/2006 | Sauer |
| 2007/0158204 | A1 | 7/2007 | Taylor et al. |
| 2007/0269648 | A1 | 11/2007 | Schuh et al. |
| 2007/0278105 | A1 | 12/2007 | Ettel |
| 2008/0063866 | A1 | 3/2008 | Allen et al. |
| 2008/0093221 | A1 | 4/2008 | Basol |
| 2008/0102360 | A1 | 5/2008 | Stimits et al. |
| 2008/0226976 | A1 | 9/2008 | Stimits |
| 2008/0245669 | A1 | 10/2008 | Yoshioka et al. |
| 2008/0271995 | A1 | 11/2008 | Savastiouk et al. |
| 2008/0283236 | A1 | 11/2008 | Akers et al. |
| 2009/0004465 | A1 | 1/2009 | Kano et al. |
| 2009/0101511 | A1 | 4/2009 | Lochtman et al. |
| 2009/0114530 | A1 | 5/2009 | Noda et al. |
| 2009/0130424 | A1 | 5/2009 | Tholen et al. |
| 2009/0130425 | A1 | 5/2009 | Whitaker |
| 2009/0155617 | A1 | 6/2009 | Kim et al. |
| 2009/0283410 | A1 | 11/2009 | Sklar et al. |
| 2010/0078330 | A1 | 4/2010 | Hyodo |
| 2010/0116675 | A1 | 5/2010 | Sklar et al. |
| 2010/0187117 | A1 | 7/2010 | Lingenfelter et al. |
| 2010/0304063 | A1 | 12/2010 | McCrea et al. |
| 2010/0304179 | A1 | 12/2010 | Facchini et al. |
| 2010/0319757 | A1 | 12/2010 | Oetting |
| 2011/0111296 | A1 | 5/2011 | Berdichevsky et al. |
| 2011/0162970 | A1 | 7/2011 | Sato |
| 2011/0180413 | A1 | 7/2011 | Whitaker et al. |
| 2011/0186582 | A1 | 8/2011 | Whitaker et al. |
| 2011/0256356 | A1 | 10/2011 | Tomantschger et al. |
| 2011/0277313 | A1 | 11/2011 | Soracco et al. |
| 2012/0118745 | A1 | 5/2012 | Bao |
| 2012/0135270 | A1 | 5/2012 | Wilbuer et al. |
| 2012/0231574 | A1 | 9/2012 | Wang |
| 2012/0282417 | A1 | 11/2012 | Garcia et al. |
| 2013/0052343 | A1 | 2/2013 | Dieny et al. |
| 2013/0071755 | A1 | 3/2013 | Oguro |
| 2013/0075264 | A1 | 3/2013 | Cummings et al. |
| 2013/0130057 | A1 | 5/2013 | Caldwell et al. |
| 2013/0186852 | A1 | 7/2013 | Dietrich et al. |
| 2013/0220831 | A1 | 8/2013 | Vidaurre Heiremans et al. |
| 2013/0224008 | A1 | 8/2013 | Cheung et al. |
| 2013/0323473 | A1 | 12/2013 | Dietsch et al. |
| 2014/0163717 | A1 | 6/2014 | Das et al. |
| 2014/0178637 | A1 | 6/2014 | Rajagopalan et al. |
| 2014/0231266 | A1 | 8/2014 | Sherrer et al. |
| 2015/0315716 | A1 | 11/2015 | Whitaker |
| 2015/0322588 | A1 | 11/2015 | Lomasney et al. |
| 2016/0002790 | A1 | 1/2016 | Whitaker et al. |
| 2016/0002803 | A1 | 1/2016 | Sklar |
| 2016/0002806 | A1 | 1/2016 | Lomasney |
| 2016/0002813 | A1 | 1/2016 | Lomasney |
| 2016/0024663 | A1 | 1/2016 | Lomasney |
| 2016/0047980 | A1 | 2/2016 | Page et al. |
| 2016/0145850 | A1 | 5/2016 | Cook et al. |
| 2016/0159488 | A1 | 6/2016 | Roach et al. |
| 2016/0160863 | A1 | 6/2016 | Roach et al. |
| 2016/0214283 | A1 | 7/2016 | Schick et al. |
| 2017/0191177 | A1 | 7/2017 | Whitaker et al. |
| 2017/0191179 | A1 | 7/2017 | Sklar |
| 2017/0275775 | A1 | 9/2017 | Guadarrama Calderon et al. |
| 2018/0016694 | A1 | 1/2018 | Bao |
| 2018/0066375 | A1 | 3/2018 | Morgan et al. |
| 2018/0071980 | A1 | 3/2018 | Lomasney et al. |
| 2018/0245229 | A1 | 8/2018 | Whitaker et al. |
| 2019/0309430 | A1 | 10/2019 | Sklar |
| 2019/0360116 | A1 | 11/2019 | Collinson et al. |
| 2020/0115998 | A1 | 4/2020 | Lomasney |
| 2020/0131658 | A1 | 4/2020 | Lomasney et al. |
| 2020/0173032 | A1 | 6/2020 | Lomasney |
| 2020/0277706 | A1 | 9/2020 | Lomasney et al. |
| 2020/0283923 | A1 | 9/2020 | Lomasney |
| 2020/0318245 | A1 | 10/2020 | Lomasney |
| 2020/0354846 | A1 | 11/2020 | Whitaker et al. |
| 2020/0392642 | A1 | 12/2020 | Lomasney |
| 2021/0054522 | A1 | 2/2021 | Lomasney et al. |
| 2021/0071303 | A1 | 3/2021 | Whitaker et al. |
| 2021/0147995 | A1 | 5/2021 | Sklar |

FOREIGN PATENT DOCUMENTS

| | | | |
|---|---|---|---|
| CN | 1924110 | A | 3/2007 |
| CN | 101113527 | A | 1/2008 |
| CN | 101195924 | A | 6/2008 |
| CN | 102148339 | A | 8/2011 |
| CN | 105442011 | A | 3/2016 |
| DE | 39 02 057 | A1 | 7/1990 |
| DE | 10 2004 006 441 | A1 | 12/2005 |
| EP | 1 688 518 | A2 | 8/2006 |
| EP | 2 189 554 | A1 | 5/2010 |
| JP | S47-2005 | A | 2/1972 |
| JP | S47-33925 | A | 11/1972 |
| JP | S52-109439 | A | 9/1977 |
| JP | 58-197292 | A | 11/1983 |
| JP | S60-97774 | A | 5/1985 |
| JP | S61-99692 | A | 5/1986 |
| JP | H0I-132793 | A | 5/1989 |
| JP | 2-214618 | A | 8/1990 |
| JP | H05-251849 | A | 9/1993 |
| JP | H06-196324 | A | 7/1994 |
| JP | 07-065347 | A | 3/1995 |
| JP | H09-119000 | A | 5/1997 |
| JP | 2000-239888 | A | 9/2000 |
| JP | 2001-152388 | A | 6/2001 |
| JP | 2001-181893 | A | 7/2001 |
| JP | 2002-53999 | A | 2/2002 |
| JP | 2006-035176 | A | 2/2006 |
| JP | 2009-215590 | A | 9/2009 |
| KR | 2003-0092463 | A | 12/2003 |

(56) References Cited

FOREIGN PATENT DOCUMENTS

| | | | |
|---|---|---|---|
| KR | 10-2015-0132043 | A | 11/2015 |
| SU | 36121 | A1 | 4/1934 |
| WO | 83/02784 | | 8/1983 |
| WO | 95/14116 | | 5/1995 |
| WO | 2004/001100 | | 12/2003 |
| WO | 2007/045466 | | 4/2007 |
| WO | 2007/138619 | | 12/2007 |
| WO | 2008/057401 | A2 | 5/2008 |
| WO | 2009/045433 | | 4/2009 |
| WO | 2011/033775 | A1 | 3/2011 |
| WO | 2011/110346 | A2 | 9/2011 |
| WO | 2012/145750 | A2 | 10/2012 |
| WO | 2013/133762 | A1 | 9/2013 |
| WO | 2017/097300 | A1 | 6/2017 |

OTHER PUBLICATIONS

U.S. Appl. No. 16/671,104, filed Oct. 31, 2019.

"Appendix 1: Literature review (Task 1): Literature review concerning the improvement of galvanneal (GA) coating adherence during shear test of adhesively bonded GA steel sheets," 70 pages, no date.

"Low-temperature iron plating," web blog article found at http:blog.sina.com.cn/s/blog_48ed0a9c0100024z.html, published Mar. 22, 2006, 3 pages. (with English translation).

Adams et al., "Controlling strength and toughness of multilayer films: A new multiscalar approach," *J. Appl. Phys.* 74(2):1015-1021, 1993.

Aizenberg et al., "Skeleton of *Euplectella* sp.: Structural Hierarchy from the Nanoscale to the Macroscale," *Science* 309:215-218, 2005.

Alfantazi et al., "Synthesis of nanocrystalline Zn—Ni alloy coatings," *JMSLD5* 15(15):1361-1363, 1996.

Atanassov et al., "Electrodeposition and properties of nickel-manganese layers," *Surface and Coatings Technology* 78:144-149, 1996.

Bakonyi et al., "Electrodeposited multilayer films with giant magnetoresistance (GMR): Progress and problems," *Progress in Materials Science* 55:107-245, 2010.

Bartlett et al., "Electrochemical deposition of macroporous platinum, palladium and cobalt films using polystyrene latex sphere templates," *Chem. Commun.*, pp. 1671-1672, 2000.

Beattie et al., "Comparison of Electrodeposited Copper-Zinc Alloys Prepared Individually and Combinatorially," *J. Electrochem. Soc.* 150(11):C802-C806, 2003.

Bird et al., "Giant Magnetoresistance in Electrodeposited Ni/Cu and Co/Cu Multilayers," *J. Electrochem. Soc.* 142(4):L65-L66, 1995.

Blum, "The Structure and Properties of Alternately Electrodeposited Metals," presented at the Fortieth General Meeting of the American Electrochemical Society, Lake Placid, New York, Oct. 1, 1921, 14 pages.

Cohen et al., "Electroplating of Cyclic Multilayered Alloy (CMA) Coatings," *J. Electrochem. Soc.* 130(10):1987-1995, 1983.

Cowles, "High cycle fatigue in aircraft gas turbines—an industry perspective," *International Journal of Fracture* 80(2-3):147-163, 1996.

"Designing with Metals: Dissimilar Metals and The Galvanic Series," printed Oct. 5, 2017, 3 pages.

Despic et al., "Electrochemical Formation of Laminar Deposits of Controlled Structure and Composition," *J. Electrochem. Soc.* 136(6):1651-1657, 1989.

Dini et al. "On the High Temperature Ductility Properties of Electrodeposited Sulfamate Nickel," *Plating and Surface Finishing* 65(2):36-40. 1978.

Etminanfar et al., "Corrosion resistance of multilayer coatings of nanolayered Cr/Ni electrodeposited from Cr(III)-Ni(II) bath," *Thin Solid Films* 520:5322-5327, 2012.

Gasser et al., "Materials Design for Acoustic Liners: an Example of Tailored Multifunctional Materials," *Advanced Engineering Materials* 6(1-2):97-102, 2004.

Georgescu et al., "Magnetic Behavior of [Ni/Co—Ni—Mg—N] x n Cylindrical Multilayers prepared by Magnetoelectrolysis," *Phys. Stat. Sol.* (*a*) 189(3):1051-1055, 2002.

Ghanem et al., "A double templated electrodeposition method for the fabrication of arrays of metal nanodots," *Electrochemistry Communications* 6:447-453, 2004.

Grimmett et al., "Pulsed Electrodeposition of Iron-Nickel Alloys," *J. Electrochem. Soc.* 137(11):3414-3418, 1990.

Hariyanti, "Electroplating of Cu—Sn Alloys and Compositionally Modulated Multilayers of Cu—Sn—Zn—Ni Alloys on Mild Steel Substrate," Master of Science Thesis, University of Science, Malaysia, Penang, Malaysia, 2007.

Harris et al., "Improved Single Crystal Superalloys, CMSX-4® (SLS)[La+Y] and CMSX-486®," *TMS* (*The Minerals, Metals & Materials Society*), *Superalloys*, p. 45-52, 2004.

Huang et al., "Hardness variation and annealing behavior of a Cr—Ni multilayer electroplated in a trivalent chromium-based bath," *Surface and Coatings Technology* 203:3320-3324, 2009.

Huang et al., "Characterization of Cr—Ni multilayers electroplated from a chromium(III)-nickel(II) bath using pulse current," *Scripta Materialia*, 57:61-64, 2007.

Igawa et al., "Fabrication of SiC fiber reinforced SiC composite by chemical vapor infiltration for excellent mechanical properties," *Journal of Physics and Chemistry of Solids* 66:551-554. 2005.

Ivanov et al., "Corrosion resistance of compositionally modulated multilayered Zn—Ni alloys deposited from a single bath," *Journal of Applied Electrochemistry* 33:239-244, 2003.

Jeong et al., "The Effect of Grain Size on the Wear Properties of Electrodeposited Nanocrystalline Nickel Coatings," *Scripta Mater.* 44:493-499, 2001.

Jia et al., "LIGA and Micromolding" Chapter 4, *The MEMS Handbook*, 2nd edition, CRC Press, Boca Raton, Florida, Edited by Mohamed Gad-el-Hak, 2006.

Kalu et al., "Cyclic voltammetric studies of the effects of time and temperature on the capacitance of electrochemically deposited nickel hydroxide," *Journal of Power Sources* 92:163-167, 2001.

Kaneko et al., "Vickers hardness and deformation of Ni/Cu nanomultilayers electrodeposited on copper substrates," Eleventh International Conference on Intergranular and Interphase Boundaries 2004, *Journal of Material Science* 40:3231-3236, 2005.

Karimpoor et al., "Tensile Properties of Bulk Nanocrystalline Hexagonal Cobalt Electrodeposits," *Materials Science Forum* 386-388:415-420, 2002.

Keckes et al., "Cell-wall recovery after irreversible deformation of wood," *Nature Materials* 2:810-814, 2003.

Kirilova et al., "Corrosion behaviour of Zn—Co compositionally modulated multilayers electrodeposited from single and dual baths," *Journal of Applied Electrochemistry* 29:1133-1137, 1999.

Kockar et al., "Effect of potantiostatic waveforms on properties of electrodeposited NiFe alloy films," *Eur. Phys. J.* B(42):497-501, 2004.

Kruth et al., "Progress in Additive Manufacturing and Rapid Prototyping" *CIRP Annals* 47(2):525-540, 1998.

Lashmore et al., "Electrodeposited Cu—Ni Textured Superlattices," *J. Electrochem. Soc.* 135(5):1218-1221, 1988.

Lashmore et al., "Electrodeposited Multilayer Metallic Coatings," *Encyclopedia of Materials Science and Engineering*, Supp. vol. 1:136-140, 1988.

Leisner et al., "Methods for electrodepositing composition-modulated alloys," *Journal of Materials Processing Technology* 58:39-44, 1996.

Leith et al., "Characterization of Flow-Induced Compositional Structure in Electrodeposited NiFe Composition-Modulated Alloys" *J. Electrochem. Soc.* 145(8):2821-2833, 1998.

Lekka et al., "Corrosion and wear resistant electrodeposited composite coatings," *Electrochimica Acta* 50:4551-4556, 2005.

Lewis et al., "Stability in thin film multilayers and microlaminates: the role of free energy, structure, and orientation at interfaces and grain boundaries," *Scripta Materialia* 48:1079-1085, 2003.

Low et al., "Electrodeposition of composite coatings containing nanoparticles in a metal deposit," *Surface & Coating Technology* 201:371-383, 2006.

(56) References Cited

OTHER PUBLICATIONS

Malone, "New Developments in Electroformed Nickel-Based Structural Alloys," *Plating and Surface Finishing* 74(1):50-56, 1987.
Marchese, "Stress Reduction of Electrodeposited Nickel," *Journal of the Electrochemical Society* 99(2):39-43, 1952.
Meng et al., "Fractography, elastic modulus, and oxidation resistance of Novel metal-intermetallic $Ni/Ni_3Al$ multilayer films," *J. Mater. Res.* 17(4):790-796, 2002.
Naslain et al., "Synthesis of highly tailored ceramic matrix composites by pressure-pulsed CVI," *Solid State Ionics* 141-142:541-548, 2001.
Naslain, "The design of the fibre-matrix interfacial zone in ceramic matrix composites," *Composites Part A* 29A: 1145-1155, 1998.
Nicholls, "Advances in Coating Design for High-Performance Gas Turbines," *MRS Bulletin*, p. 659-670, 2003.
Onoda et al., "Preparation of amorphous/crystalloid soft magnetic multilayer Ni—Co—B alloy films by electrodeposition," *Journal of Magnetism and Magnetic Materials* 126(1-3):595-598, 1993.
Parkin et al., "Oscillations in Exchange Coupling and Magnetoresistance in Metallic Superlattice Structures: Co/Ru, Co/Cr, and Fe/Cr," *Physical Review Letters* 64(19):2304-2307, 1990.
Pilone et al., "Model of Multiple Metal Electrodeposition in Porous Electrodes," *Journal of the Electrochemical Society* 153(5):D85-D90, 2006.
Podlaha et al. "Induced Codeposition: I. An Experimental Investigation of Ni—Mo Alloys," *J. Electrochem. Soc.* 143(3):885-892, 1996.
Ross, "Electrodeposited Multilayer Thin Films," *Annual Review of Materials Science* 24:159-188, 1994.
Rousseau et al., "Single-bath Electrodeposition of Chromium-Nickel Compositionally Modulated Multilayers (CMM) From a Trivalent Chromium Bath," *Plating and Surface Finishing*, p. 106-110, 1999.
Saleh et al., "Effects of electroplating on the mechanical properties of stereolithography and laser sintered parts," *Rapid Prototyping Journal* 10(5)305-315, 2004.
Sanders et al., "Mechanics of hollow sphere foams," *Materials Science and Engineering* A347:70-85, 2003.
Sartwell et al., "Replacement of Chromium Electroplating on Gas Turbine Engine Components Using Thermal Spray Coatings," Report No. NRL/MR/6170-05-8890, Naval Research Laboratory, 2005, (207 pages).
Schwartz, "Multiple-Layer Alloy Plating," ASM Handbook 5: Surface Engineering, p. 274-276, 1994.
Sherik, "Synthesis, Structure and Properties of Electrodeposited Bulk Nanocrystalline Nickel," Master's Thesis, Queen's University, Ontario, Canada, 1993.
Shishkovski, "Laser synthesis of functionally graded meso structures and bulk products," FIZMATLIT, Moscow, Russia, pp. 30-38, 2009, (with English Abstract).
Simunovich et al., "Electrochemically Layered Copper-Nickel Nanocomposites with Enhanced Hardness," *J. Electrochem. Soc.* 141(1):L10-L11, 1994.
Sperling et al., "Correlation of stress state and nanohardness via heat treatment of nickel-aluminide multilayer thin films," *J. Mater. Res.* 19(11):3374-3381, 2004.
Srivastava et al., "Corrosion resistance and microstructure of electrodeposited nickel-cobalt alloy coatings," *Surface & Coatings Technology* 201:3051-3060, 2006.
Stephenson, Jr., "Development and Utilization of a High Strength Alloy for Electroforming," *Plating* 53(2): 183-192, 1966.
Suresh, "Graded Materials for Resistance to Contact Deformation and Damage," *Science* 292:2447-2451, 2001.
Switzer et al., "Electrodeposited Ceramic Superlattices," *Science* 247(4941)444-446, 1990.
Tench et al., "Considerations in Electrodeposition of Compositionally Modulated Alloys," *J. Electrochem. Soc.* 737(10):3061-3066, 1990.
Tench et al., "Enhanced Tensile Strength for Electrodeposited Nickel-Copper Multilayer Composites," *Metallurgical Transactions A* (15A):2039-2040, 1984.
Thangaraj et al., "Corrosion behavior of composition modulated multilayer Zn—Co electrodeposits produced using a single-bath technique," *J. of Appl. Electrochem.* 39:339-345, 2009.
Thangaraj et al., "Surface Modification by Compositionally Modulated Multilayered Zn—Fe Coatings," *Chinese Journal of Chemistry* 26:2285-2291, 2008.
Tokarz et al., "Preparation, structural and mechanical properties of electrodeposited Co/Cu multilayers." p*hys. stat. sol.* (*c*) 5(11):3526-3529, 2008.
Touchstone Research Laboratory, Ltd., Material Safety Data Sheet, CFOAM Carbon Foams, 2008. (4 pages).
Vill et al., "Mechanical Properties of Tough Multiscalar Microlaminates," *Acta metall. mater.* 43(2):427-437, 1995.
Voevodin et al., "Superhard, functionally gradient, nanolayered and nanocomposite diamond-like carbon coatings for wear protection," *Diamond and Related Materials* 7:463-467, 1998.
Wearmouth et al., "Electroforming with Heat-Resistant, Sulfur-Hardened Nickel," *Plating and Surface Finishing* 66(10):53-57, 1979.
Weil et al., "Pulsed Electrodeposition of Layered Brass Structures," *Metallurgical Transactions A* 19A:1569-1573, 1988.
Weil et al., "Properties of Composite Electrodeposits," U.S. Army Research Office, Final Report, Contract No. DAALO3-87-K-0047, 21 pages, 1990.
Wikipedia, "Gold," URL= http://en.wikipedia.org/wiki/Gold, version modified Nov. 3, 12 pages, 2008.
Wikipedia, "Silver," URL= http://en.wikipedia.org/wiki/Silver, version modified Nov. 3, 12 pages, 2008.
Wilcox, "Surface Modification With Compositionally Modulated Multilayer Coatings," *The Journal of Corrosion Science and Engineering* 6(Paper 52): 2004 (5 pages).
Wu et al., "Preparation and characterization of superhard $CN_x/ZrN$ multilayers," *J. Vac. Sci. Technol. A* 15(3):946-950, 1997.
Yahalom et al., "Formation of composition-modulated alloys by electrodeposition," *Journal of Materials Science* 22:499-503, 1987.
Yang et al., "Effects of SiC sub-layer on mechanical properties of Tyranno-SA/SiC composites with multiple interlayers," *Ceramics International* 31:525-531, 2005.
Yang et al., "Enhanced elastic modulus in composition-modulated gold-nickel and copper-palladium foils," *Journal of Applied Physics* 48(3):876-879, 1977.
Yogesha et al., "Optimization of deposition conditions for development of high corrosion resistant Zn—Fe multilayer coatings," *Journal of Materials Processing Technology* 211:1409-1415, 2011.
Zabludovsky et al., "The Obtaining of Cobalt Multilayers by Programme-controlled Pulse Current," Transactions of the Institute of Metal Finishing 75(5):203-204, 1997.
U.S. Appl. No. 17/179,351, filed Feb. 18, 2021.
Paz et al., "Nano-Laminated Alloys for Improved Return on Oilfield Assets," Society of Petroleum Engineers, 2016 (14 pages).
U.S. Pat. No. 11,118,280, dated Sep. 14, 2021.
U.S. Appl. No. 17/409,688, dated Aug. 23, 2021.

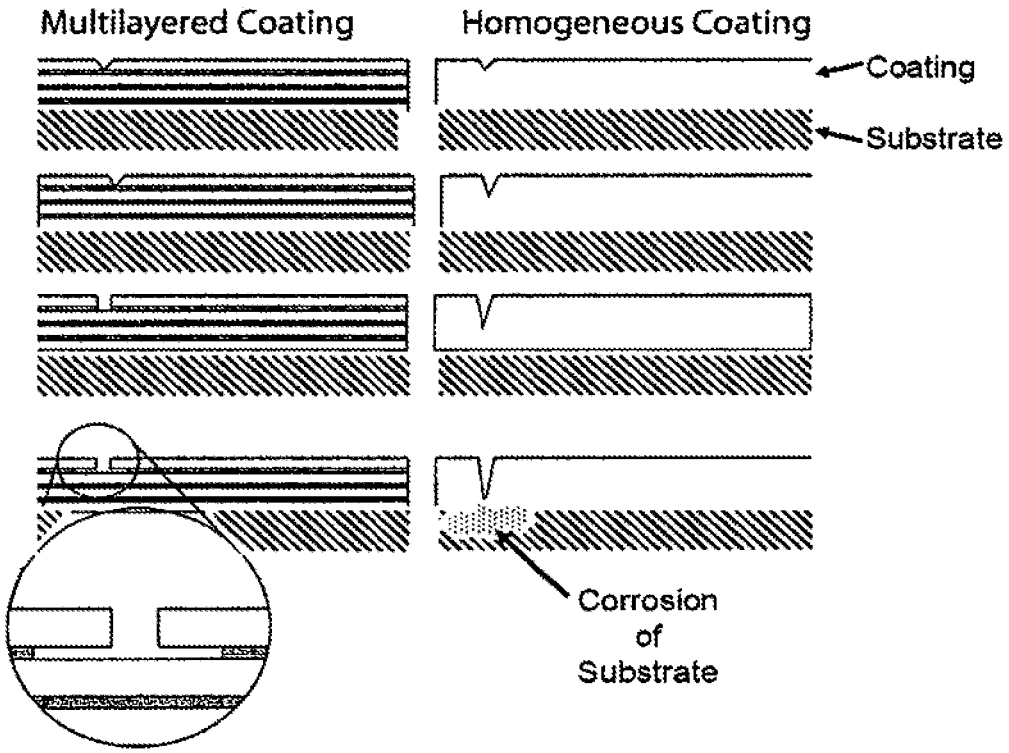
Multilayered Coating
Homogeneous Coating
Coating
Substrate
Corrosion
of
Substrate

ELECTRODEPOSITED, NANOLAMINATE COATINGS AND CLADDINGS FOR CORROSION PROTECTION

This application is a divisional of U.S. application Ser. No. 14/729,020, filed Jun. 2, 2015, which is a divisional of U.S. application Ser. No. 13/314,948, filed Dec. 8, 2011, now U.S. Pat. No. 10,253,419, issued Apr. 9, 2019, which is a continuation of PCT/US2010/037856, filed Jun. 8, 2010, which claims the benefit of U.S. Provisional Application No. 61/185,020, filed Jun. 8, 2009, each of which is incorporated herein by reference in its entirety.

BACKGROUND

Laminated metals, and in particular nanolaminated metals, are of interest for structural and thermal applications because of their unique toughness, fatigue resistance and thermal stability. For corrosion protection, however, relatively little success has been reported in the formation of corrosion-resistant coatings that are laminated on the nanoscale.

Electrodeposition has been successfully used to deposit nanolaminated coatings on metal and alloy components for a variety of engineering applications. Electrodeposition is recognized as a low-cost method for forming a dense coating on any conductive substrate. Electrodeposition has been demonstrated as a viable means for producing nanolaminated coatings, in which the individual laminates may vary in the composition of the metal, ceramic or organic-metal composition or other microstructure feature. By time varying electrodeposition parameters such as current density, bath composition, pH, mixing rate, and/or temperature, multi-laminate materials can be produced in a single bath. Alternately by moving a mandrel or substrate from one bath to another, each of which represents a different combination of parameters that are held constant, multi-laminate materials or coatings can be realized.

The corrosion behavior of organic, ceramic, metal and metal-containing coatings depends primarily on their chemistry, microstructure, adhesion, thickness and galvanic interaction with the substrate to which they are applied. In the case of sacrificial metal or metal-containing coatings, such as zinc on an iron-based substrate, the coating is less electronegative than the substrate and so oxidation of the coating occurs preferentially, thus protecting the substrate. Because these coatings protect by providing an oxidation-preferred sacrificial layer, they will continue to work even when marred or scratched. The performance of sacrificial coatings depends heavily on the rate of oxidation of the coating layer and the thickness of the sacrificial layer. Corrosion protection of the substrate only lasts so long as the sacrificial coating is in place and may vary depending on the environment that the coating is subjected to and the resulting rate of coating oxidation.

Alternately, in the case of a barrier coating, such as nickel on an iron-based substrate, the coating is more electronegative than the substrate and thus works by creating a barrier to oxidative corrosion. In A-type metals, such as Fe, Ni, Cr and Zn, it is generally true that the higher the electronegativity, the greater the nobility (non reactivity). When the coating is more noble than the substrate, if that coating is marred or scratched in any way, or if coverage is not complete, these coatings will not work, and may accelerate the progress of substrate corrosion at the substrate: coating interface, resulting in preferential attack of the substrate. This is also true when ceramic coatings are used. For example, it has been reported in the prior art that while fully dense TiN coatings are more noble than steel and aluminum in resistance to various corrosive environments, pinholes and micropores that can occur during processing of these coating are detrimental to their corrosion resistance properties. In the case of barrier coatings, pinholes in the coating may accelerate corrosion in the underlying metal by pitting, crevice or galvanic corrosion mechanisms.

Many approaches have been utilized to improve the corrosion resistance of barrier coatings, such as reducing pinhole defects through the use of a metallic intermediate layer or multiple layering schemes. Such approaches are generally targeted at reducing the probability of defects or reducing the susceptibility to failure in the case of a defect, mar or scratch. One example of a multiple layering scheme is the practice commonly found in the deployment of industrial coatings, which involves the use of a primer, containing a sacrificial metal such as zinc, coupled with a highly-crosslinked, low surface energy topcoat (such as a fluorinated or polyurethane topcoat). In such case, the topcoat acts as a barrier to corrosion. In case the integrity of the topcoat is compromised for any reason, the metal contained in the primer acts as a sacrificial media, thus sacrificially protecting the substrate from corrosion.

Dezincification is a term is used to mean the corroding away of one constituent of any alloy leaving the others more or less in situ. This phenomenon is perhaps most common in brasses containing high percentages of zinc, but the same or parallel phenomena are familiar in the corrosion of aluminum bronzes and other alloys of metals of widely different chemical affinities. Dezincification usually becomes evident as an area with well-defined boundaries, and within which the more noble metal becomes concentrated as compared with the original alloy. In the case of brass the zinc is often almost completely removed and copper is present almost in a pure state, but in a very weak mechanical condition. Corrosion by dezincification usually depends on the galvanic differential between the dissimilar metals and the environmental conditions contributing to corrosion. Dezincification of alloys results in overall loss of the structural integrity of the alloy and is considered one of the most aggressive forms of corrosion.

Coatings that may represent the best of both the sacrificial coating and the barrier coating are those that are more noble than the substrate and creates a barrier to corrosion, but, in case that coating is compromised, is also less noble than the substrate and will sacrificially corrode, thus protecting the substrate from direct attack.

SUMMARY OF THE INVENTION

In one embodiment of the technology described herein, the phenomena observed in dezincification of alloys is leveraged to enable corrosion resistant coatings that are both more and less noble than the substrate, and which protect the substrate by acting both as a barrier and as a sacrificial coating. Other embodiments and advantages of this technology will become apparent upon consideration of the following description.

The technology described herein includes in one embodiment an electrodeposited, corrosion-resistant multilayer coating or cladding, which comprises multiple nanoscale layers that periodically vary in electrodeposited species or electrodeposited microstructures (electrodeposited species microstructures), wherein variations in said layers of said electrodeposited species or electrodeposited species microstructure result in galvanic interactions between the layers, said nanoscale layers having interfaces there between.

The technology described herein also provides an electrodeposition method for producing a corrosion resistant multilayer coating or cladding comprising the steps of:

a) placing a mandrel or a substrate to be coated in a first electrolyte containing one or more metal ions, ceramic particles, polymer particles, or a combination thereof; and b) applying electric current and varying in time one or more of: the amplitude of the electrical current, electrolyte temperature, electrolyte additive concentration, or electrolyte agitation, in order to produce periodic layers of electrodeposited species or periodic layer of electrodeposited species microstructures; and c) growing a multilayer coating under such conditions until the desired thickness of the multilayer coating is achieved.

Such a method may further comprising after step (c), step (d), which comprises removing the mandrel or the substrate from the bath and rinsing.

The technology described herein further provides an electrodeposition method for producing a corrosion resistant multilayer coating or cladding comprising the steps of:

a) placing a mandrel or substrate to be coated in a first electrolyte containing one or more metal ions, ceramic particles, polymer particles, or a combination thereof; and b) applying electric current and varying in time one or more of: the electrical current, electrolyte temperature, electrolyte additive concentration, or electrolyte agitation, in order to produce periodic layers of electrodeposited species or periodic layer of electrodeposited species microstructures; and c) growing a nanometer-thickness layer under such conditions; and d) placing said mandrel or substrate to be coated in a second electrolyte containing one or more metal ions that is different from said first electrolyte, said second electrolyte containing metal ions, ceramic particles, polymer particles, or a combination thereof; and e) repeating steps (a) through (d) until the desired thickness of the multilayer coating is achieved;

wherein steps (a) through (d) are repeated at least two times. Such a method may further comprising after step (e), step (f) which comprises removing the mandrel or the coated substrate from the bath and rinsing.

Also described herein is an electrodeposited, corrosion-resistant multilayer coating or cladding, which comprises multiple nanoscale layers that vary in electrodeposited species microstructure, which layer variations result in galvanic interactions occurring between the layers. Also described is a corrosion-resistant multilayer coating or cladding, which comprises multiple nanoscale layers that vary in electrodeposited species, which layer variations result in galvanic interactions occurring between the layers.

The coating and claddings described herein are resistant to corrosion due to oxidation, reduction, stress, dissolution, dezincification, acid, base, or sulfidation and the like.

BRIEF DESCRIPTION OF THE DRAWINGS

FIG. 1 shows a schematic of a substrate having the "Multilayered Coating" of a preferred embodiment (on the left of FIG. 1) and a schematic of a substrate having a "Homogeneous Coating" as is known in the art (on the right of FIG. 1). Both the left and right side schematics represent how a pinhole, a micropore or damage to a coating changes over time (in sequence from the top to the bottom of FIG. 1) relative to the substrate shown on the bottom of each of the sequences. The schematic illustrates a few representative layers that are not to scale with the substrate. In typical embodiments coating layers are on the nanoscale and present in a greater number than shown in FIG. 1.

DETAILED DESCRIPTION

In one embodiment an electrodeposited corrosion-resistant multilayer coating comprised of individual layers with thicknesses on the nanometer scale is provided. In such an embodiment the individual layers can differ in electronegativity from adjacent layers.

In other embodiments, the present technology provides corrosion-resistant multilayer coatings or claddings (together herein referred to as a "coating") that comprise multiple nanoscale layers having variations in the composition of metal, alloy, polymer, or ceramic components, or combination thereof (together herein referred to as "electrodeposited species").

In such embodiments the variations in the compositions between layers results in galvanic interactions occurring between the layers.

In another embodiment, the present technology provides a corrosion-resistant multilayer coating that comprises multiple nanoscale layers having layer variations in grain size, crystal orientation, grain boundary geometry, or combination thereof (together herein referred to as "electrodeposited species microstructure(s)"), which layer variations result in galvanic interactions occurring between the layers.

In another embodiment multilayer coating or cladding is provided for, in which the layers vary in electronegativity or in nobility, and in which the rate of corrosion can be controlled by controlling the difference in electronegativity or in the reactivity (or "nobility") of adjacent layers.

One embodiment of the present technology provides a multilayer coating or cladding in which one of the periodic layers is less noble than the other layer and is less noble than the substrate, thus establishing a periodic sacrificial layer in the multilayer coating.

As used herein "layers that periodically vary" means a series of two or more non-identical layers (non identical "periodic layers") that are repeatedly applied over an underlying surface or mandrel. The series of non-identical layers can include a simple alternating pattern of two or more non-identical layers (e.g., layer 1, layer 2, layer 1, layer 2, etc.) or in another embodiment may include three or more non-identical layers (e.g., layer 1, layer 2, layer 3, layer 1, layer 2, layer 3, etc.). More complex alternating patterns can involve two, three, four, five or more layers arranged in constant or varying sequences (e.g., layer 1, layer 2, layer 3, layer 2, layer 1, layer 2, layer 3, layer 2, layer 1, etc.). In one embodiment, a series of two layers is alternately applied 100 times to provide a total of 200 layers having 100 periodic layers of a first type alternated with 100 periodic layers of a second type, wherein the first and second type of periodic layer are not identical. In other embodiments, "layers that periodically vary" include 2 or more, 3 or more, 4 or more, or 5 or more layers that are repeatedly applied about 5, 10, 20, 50, 100, 200, 250, 500, 750, 1,000, 1,250, 1,500, 1,750, 2,000, 3,000, 4,000, 5,000, 7,500, 10,000, 15,000, 20,000 or more times.

As used herein, a "periodic layer" is an individual layer within "layers that periodically vary".

In another embodiment, the present technology provides a multilayer coating or cladding in which one of the periodic layers is more noble than the other layer and is more noble than the substrate, thus establishing a periodic corrosion barrier layer in the multilayer coating.

In another embodiment, the present technology provides a multilayer coating in which one of the periodic layers is less noble than the adjacent layers and all layers are less noble than the substrate.

In still another embodiment, the present technology provides a multilayer coating or cladding in which one of the periodic layers is more noble than the adjacent layers and all layers are more noble than the substrate.

One embodiment of the present technology provides for a corrosion-resistant multilayer coating or cladding compositions that comprise individual layers, where the layers are not discrete, but rather exhibit diffuse interfaces with adjacent layers. In some embodiments the diffuse region between layers may be 0.5, 0.7, 1, 2, 5, 10, 15, 20, 25, 30, 40, 50 75, 100, 200, 400, 500, 1,000, 2,000, 4,000, 6,000, 8,000 or 10,000 nanometers. In other embodiments the diffuse region between layers may be 1 to 5, or 5 to 25, or 25 to 100, or 100 to 500, or 500 to 1,000, or 1,000 to 2,000, or 2,000 to 5,000, or 4,000 to 10,000 nanometers. The thickness of the diffuse interface may be controlled in a variety of ways, including the rate at which the electrodeposition conditions are change.

Another embodiment of the technology described herein provides a method for producing a multilayered corrosion-resistant coating that comprises multiple nanoscale layers ("nanolaminates") that vary in electrodeposited species or electrodeposited species microstructure or a combination thereof, which layers are produced by an electrodeposition process.

Where variations in electrodeposited species or combinations thereof are employed, in some embodiments, the electrodeposited species may comprise one or more of Ni, Zn, Fe, Cu, Au, Ag, Pd, Sn, Mn, Co, Pb, Al, Ti, Mg and Cr, $Al_2O_3$, $SiO_2$, TiN, BoN, $Fe_2O_3$, MgO, and $TiO_2$, epoxy, polyurethane, polyaniline, polyethylene, poly ether ether ketone, polypropylene.

In other embodiments the electrodeposited species may comprise one or more metals selected from Ni, Zn, Fe, Cu, Au, Ag, Pd, Sn, Mn, Co, Pb, Al, Ti, Mg and Cr. Alternatively, the metals may be selected from: Ni, Zn, Fe, Cu, Sn, Mn, Co, Pb, Al, Ti, Mg and Cr; or from Ni, Zn, Fe, Cu, Sn, Mn, Co, Ti, Mg and Cr; or from Ni, Zn, Fe, Sn, and Cr. The metal may be present in any percentage. In such embodiments the percentage of each metal may independently selected about 0.001, 0.005, 0.01, 0.05, 0.1, 0.5, 1, 5, 10, 15, 20, 25, 30, 30, 35, 40, 45, 50, 55, 60, 65, 70, 75, 80, 85, 90, 95, 98, 99, 99.9, 99.99, 99.999 or 100 percent of the electrodeposited species. Unless otherwise indicated, the percentages provided herein refer to weight percentages.

In other embodiments the electrodeposited species may comprise one or more ceramics (e.g., metals oxides or metal nitrides) selected from $Al_2O_3$, $SiO_2$, TiN, BoN, $Fe_2O_3$, MgO, SiC, ZrC, CrC, diamond particulates, and $TiO_2$. In such embodiments the percentage of each ceramic may independently selected about 0.001, 0.005, 0.01, 0.05, 0.1, 0.5, 1, 5, 10, 15, 20, 25, 30, 30, 35, 40, 45, 50, 55, 60, 65, 70, 75, 80, 85, 90, 95, 98, 99, 99.9, 99.99, 99.999 or 100 percent of the electrodeposited species.

In still other embodiments the electrodeposited species may comprise one or more polymers selected from epoxy, polyurethane, polyaniline, polyethylene, poly ether ether ketone, polypropylene, and poly(3,4-ethylenedioxythiophene) poly(styrenesulfonate). In such embodiments the percentage of each polymer may independently selected about 0.001, 0.005, 0.01, 0.05, 0.1, 0.5, 1, 5, 10, 15, 20, 25, 30, 30, 35, 40, 45, 50, 55, 60, 65, 70, 75, 80, 85, 90, 95, 98, 99, 99.9, 99.99, 99.999 or 100 percent of the electrodeposited species.

Another embodiment of the present technology provides a electrodeposition method for producing a nanolaminated, corrosion resistant coating which reduces through-hole defects in the overall corrosion resistant coating. Such methods include those wherein multi-layered coatings or claddings are applied to a substrate or mandrel as illustrated in FIG. 1.

As shown on the left of FIG. 1, the multilayer coating of a preferred embodiment is disposed to have two alternating (light and dark) layers covering a substrate. In the embodiment of the left side of FIG. 1, the light layer is a protective layer and the dark layer is a sacrificial layer. As the sequence shows, over time the hole in the light layer expands slightly in a direction parallel to the surface of the substrate, and the sacrificial dark layer under the damaged light layer is consumed in a direction parallel with the surface of the substrate. It is also noted that the hole in the outermost (exposed) layer of the multilayer coating does not expand to breach the second light layer disposed between the hole and the substrate, thereby protecting the substrate from corrosion. In a preferred embodiment, corrosion is confined to the less-noble layers (the dark layers), with the layers being protected cathodically and the corrosion proceeding laterally rather than towards the substrate.

As shown on the right of FIG. 1, the homogeneous coating of the prior art is disposed to have a single layer covering a substrate. As the sequence shows, over time the hole in the single layer expands in a direction normal to the surface of the substrate until ultimately reaching the substrate, which thereafter is affected by corrosion or other forms of degradation.

In one embodiment, the technology described herein describes a method for producing a multilayer, nanolaminated coating by an electrodeposition process carried out in a single bath, comprising the steps of:

a) placing a mandrel or a substrate to be coated in a first electrolyte containing one or more metal ions, ceramic particles, polymer particles, or a combination thereof; and b) applying electric current and varying in time one or more of: the amplitude of the electrical current, electrolyte temperature, electrolyte additive concentration, or electrolyte agitation, in order to produce periodic layers of electrodeposited species or periodic layer of electrodeposited species microstructures; and c) growing a multilayer coating under such conditions until the desired thickness of the multilayer coating is achieved.

Such a method may further comprise after step (c), step (d) removing the mandrel or the substrate from the bath and rinsing.

The technology described herein also sets forth a method for producing a multilayer, nanolaminated coating or cladding using serial electrodeposition in two or more baths comprising the steps of:

a) placing a mandrel or substrate to be coated in a first electrolyte containing one or more metal ions, ceramic particles, polymer particles, or a combination thereof; and b) applying electric current and varying in time one or more of: the electrical current, electrolyte temperature, electrolyte additive concentration, or electrolyte agitation, in order to produce periodic layers of electrodeposited species or periodic layer of electrodeposited species microstructures; and c) growing a nanometer-thickness layer under such conditions; and d) placing said mandrel or substrate to be coated in a second electrolyte containing one or more metal ions that is different from said first electrolyte, said second electrolyte containing metal ions, ceramic particles, polymer particles, or a combination thereof; and e) repeating steps (a) through (d) until the desired thickness of the multilayer coating is achieved; wherein steps (a) through (d) are repeated at least two times.

Such a method may further comprise after step (e), step (f) removing the mandrel or the coated substrate from the bath and rinsing.

Corrosion-resistant multilayer coatings can be produced on a mandrel, instead of directly on a substrate to make a free-standing material or cladding. Cladding produced in this manner may be attached to the substrate by other means, including welding, gluing or through the use of other adhesive materials.

The multilayer coatings can comprise layers of metals that are electrolytically deposited from aqueous solution, such as Ni, Zn, Fe, Cu, Au, Ag, Pd, Sn, Mn, Co, Pb and Cr. The multilayer coating can also comprise alloys of these metals, including, but not limited to: ZnFe, ZnCu, ZnCo, NiZn, NiMn, NiFe, NiCo, NiFeCo, CoFe, CoMn. The multilayer can also comprise metals that are electrolytically deposited from a molten salt or ionic liquid solution. These include those metals previously listed, and others, including, but not limited to Al, Mg, Ti and Na. In other embodiments multilayer coatings can comprise one or more metals selected from Ni, Zn, Fe, Cu, Au, Ag, Pd, Sn, Mn, Co, Pb, Al, Ti, Mg and Cr. Alternatively, one or more metals to be electrolytically deposited may be selected from: Ni, Zn, Fe, Cu, Sn, Mn, Co, Pb, Al, Ti, Mg and Cr; or from Ni, Zn, Fe, Cu, Sn, Mn, Co, Ti, Mg and Cr; or from Ni, Zn, Fe, Sn, and Cr.

The multilayer coating can comprise ceramics and polymers that are electrophoretically deposited for aqueous or ionic liquid solutions, including, but not limited to $Al_2O_3$, $SiO_2$, TiN, BoN, $Fe_2O_3$, MgO, and $TiO_2$. Suitable polymers include, but are not limited to, epoxy, polyurethane, polyaniline, polyethylene, poly ether ether ketone, polypropylene.

The multilayer coating can also comprise combinations of metals and ceramics, metals and polymers, such as the above-mentioned metals, ceramics and polymers.

The thickness of the individual layers (nanoscale layers) can vary greatly as for example between 0.5 and 10,000 nanometers, and in some embodiments is about 200 nanometers per layer. The thickness of the individual layers (nanoscale layers) may also be about 0.5, 0.7, 1, 2, 5, 10, 15, 20, 25, 30, 40, 50 75, 100, 200, 400, 500, 1,000, 2,000, 4,000, 6,000, 8,000 or 10,000 nanometers. In other embodiments the layers may be about 0.5 to 1, or 1 to 5, or 5 to 25, or 25 to 100, or 100 to 300, or 100 to 400, or 500 to 1,000, or 1,000 to 2,000, or 2,000 to 5,000, or 4,000 to 10,000 nanometers.

Individual layers may be of the same thickness or different thickness. Layers that vary periodically may also vary in thickness.

The overall thickness of the coating or cladding can vary greatly as, for example, between 2 micron and 6.5 millimeters or more. In some embodiments the overall thickness of the coating or cladding can also be between 2 nanometers and 10,000 nanometers, 4 nanometers and 400 nanometers, 50 nanometers and 500 nanometers, 100 nanometers and 1,000 nanometers, 1 micron to 10 microns, 5 microns to 50 microns, 20 microns to 200 microns, 200 microns to 2 millimeters (mm), 400 microns to 4 mm, 200 microns to 5 mm, 1 mm to 6.5 mm, 5 mm to 12.5 mm, 10 mm to 20 mm, 15 mm to 30 mm.

Layer thickness can be controlled by, among other things, the application of current in the electrodeposition process. This technique involves the application of current to the substrate or mandrel to cause the formation of the coating or cladding on the substrate or mandrel. The current can be applied continuously or, more preferably, according to a predetermined pattern such as a waveform. In particular, the waveform (e.g., sine waves, square waves, sawtooth waves, or triangle waves). can be applied intermittently to promote the electrodeposition process, to intermittently reverse the electrodeposition process, to increase or decrease the rate of deposition, to alter the composition of the material being deposited, or to provide for a combination of such techniques to achieve a specific layer thickness or a specific pattern of differing layers. The current density and the period of the wave forms may be varied independently. In some embodiments current density may be continuously or discretely varied with the range between 0.5 and 2000 mA/cm$^2$. Other ranges for current densities are also possible, for example, a current density may be varied within the range between: about 1 and 20 mA/cm$^2$; about 5 and 50 mA/cm$^2$; about 30 and 70 mA/cm$^2$; 0.5 and 500 mA/cm$^2$; 100 and 2000 mA/cm$^2$; greater than about 500 mA/cm$^2$; and about 15 and 40 mA/cm$^2$ base on the surface area of the substrate or mandrel to be coated. In some embodiments the frequency of the wave forms may be from about 0.01 Hz to about 50 Hz. In other embodiments the frequency can be from: about 0.5 to about 10 Hz; 0.02 to about 1 Hz or from about 2 to 20 Hz; or from about 1 to about 5 Hz.

The multilayer coatings and claddings described herein are suitable for coating or cladding a variety of substrates that are susceptible to corrosion. In one embodiment the substrates are particularly suited for coating substrates made of materials that can corrode such as iron, steel, aluminum, nickel, cobalt, iron, manganese, copper, titanium, alloys thereof, reinforced composites and the like.

The coatings and claddings described herein may be employed to protect against numerous types of corrosion, including, but not limited to corrosion caused by oxidation, reduction. stress (stress corrosion), dissolution, dezincification, acid, base, sulfidation and the like.

Example #1

Preparation of a multilayer coating comprising nanoscale layers of zinc-iron alloy, in which the concentration of iron varies in adjacent layers.

A zinc-iron bath is produced using a commercial plating bath formula supplied by MacDermid Inc. (Waterbury, Conn.). The composition of the bath is described in Table 1.

TABLE 1

Example Plating Bath

| MacDermid Material | Composition | Product # |
|---|---|---|
| Zinc Metal | 10-12 g/l | 118326 |
| NaOH | 125-135 g/l | |
| Enviralloy Carrier | 0.5-0.6% | 174384 |
| Enviralloy Brightener | 0-0.1% | 174383 |
| Enviralloy Fe | 0.2-0.4% | 174385 |
| Enviralloy C | 4-6% | 174386 |
| Enviralloy B | 0.4-0.6% | 174399 |

TABLE 1-continued

| Example Plating Bath | | |
|---|---|---|
| MacDermid Material | Composition | Product # |
| Enviralloy Stabilizer | 0.1-0.2% | 174387 |
| Envirowetter | 0.05-0.2% | 174371 |

A steel panel is immersed into the bath and connected to a power supply. The power supply was combined with a computer generated waveform supply that provided a square waveform which alternates between 25 mA/cm$^2$ (for 17.14 seconds) and 15 mA/cm$^2$ (for 9.52 seconds). The total plating time for a M90 coating (0.9 oz of coating per square foot) is about 1.2 hrs. In this time approximately 325 layers were deposited to achieve a total thickness of 19 μm. The individual layer thickness was between 50 and 100 nm.

The coating is tested in a corrosive environment, in accordance with ASTM B117 (Standard Practice for Operating Salt Spray), and shows no evidence of red rust after 300 hours of exposure.

Example #2

Nickel Cobalt alloys have been used extensively in recent history because of its great wear and corrosion resistance. A nanolaminated Ni—Co alloy was created which contains codeposited diamond particles. The Ni—Co alloy by itself is a corrosion and wear resistant alloy. By modulating the electrode potential in the cell, it was possible to laminate the composition of the alloy. By doing this, a galvanic potential difference was established between the layers and thus created a more favorable situation for corrosion and fatigue wear. Also, two unique phases in the crystal structure of the matrix were established. The deposition rate of the diamonds has also been shown to vary with the current density of the cell.

Preparation of a multilayer coating comprising nanoscale layers of a Nickel-Cobalt alloy with diamond codeposition, in which the concentration of the metals vary in adjacent layers.

A traditional Nickel watts bath is used as the basis for the bath. The following table describes all of the components of the bath.

TABLE 2

| Example Plating Bath | |
|---|---|
| Component | Concentration |
| Nickel Sulfate | 250 g/l |
| Nickel Chloride | 30 g/l |
| Boric Acid | 40 g/l |
| Cobalt Chloride | 10 g/l |
| SDS | .01 g/l |
| Diamond (<1 micron size) | 5 g/l |

For creating samples, a steel panel is immersed into the bath and is connected to a power supply. The current density modulation was carried out between 10 mA/cm$^2$ and 35 mA/cm$^2$ with computer controlled software to form nanoscale layers. The current is applied and varied until a 20 μm thick coating had been formed on the substrate surface.

Testing for this coating has been carried out in a salf fog chamber in accordance with the ASTM B117 standers as well as taber wear tests which show the abrasion resistance to be significantly better than homogeneous coatings of Nickel-Cobalt and of stainless steel 316.

Example #3

Preparation of a Ni—Zr—Cr alloy system containing particulate precursors.

TABLE 3

| Bath Make-up | |
|---|---|
| Chemical | Conc. (g/L) |
| Nickel Sulfate | 312 |
| Nickel Chloride | 45 |
| Boric Acid | 38 |
| Surfactant (C-TAB ®) | 0.1 |

TABLE 4

| Particle Additions | |
|---|---|
| Particle | Conc. (g/L) |
| Zirconium (1-3 microns) | 40 |
| CrC (1-5 microns) | 15 |

Bath Make-Up Procedure:

1. Mix metal salts, boric acid and C-Tab at 100° F.
2. Allow full dissolution, then shift pH to between 5 and 6 with ammonium hydroxide
3. Add particles and allow full mixing
4. Particles should be allowed to mix for one day before plating to allow full surfactant coverage Plating Procedure:

1. Substrates should be prepared in accordance with ASTM standards
2. Electrolyte should be held between 100° F. and 120° F.
3. Solution should have sufficient agitation to prevent particle settling, and fluid flow should be even across the substrate
4. A 50% duty cycle pulse waveform at 75 mA/cm$^2$ effective current density is applied; the average current density of the pulse waveform can be varied and will vary particle inclusion allowing for a laminated structure with controllable deposit composition.

In a first SEM image of the plated substrates shows a high density particle incorporation of zirconium and chromium carbide particles on a steel substrate. Particle spacing is between <1 and 5 microns and the deposit is fully dense. Particles show relatively even distribution throughout the deposit. A second SEM image shows low particle density inclusions on a steel substrate. Particle spacing is between 1 and 15 microns, with some deposit cleaving at particle/matrix interface. Even particle distribution is less pronounced in the second SEM image. Minor surface roughness is seen in both deposits.

Optional Heat Treatment:

In the event the coating requires greater corrosion resistance, a heat treatment can be applied to diffuse included zirconium throughout the deposit, creating, in this case, corrosion-resistant intermetallic phases of the Ni Cr and Zr. Heat treatment may be performed by:

1. Clean the part and dry;
2. Using a furnace of any atmosphere, heat the deposit at no more than 10° C./min up to 927° C.

3. Hold at 927° C. for 2 hours and

4. Air cooling the part.

The above descriptions of exemplary embodiments of methods for forming nanolaminate structures are illustrative of the present invention. Because of variations which will be apparent to those skilled in the art, however, the present invention is not intended to be limited to the particular embodiments described above. The scope of the invention is defined in the following claims.

What is claimed is:

1. A method comprising:

forming a coating on a substrate or mandrel, the coating having a thickness from 5 microns to 50 microns and comprising a series of layers arranged in a repeating pattern, each layer of the series of layers having a thickness from about 5 nanometers to about 1,000 nanometers, the series of layers comprising:

A) a first layer of a first alloy that is less noble than the substrate or the mandrel, the first alloy comprising:

i) a first metal in a first concentration that is at least about 1 wt. %, the first metal selected from Co, Fe, Ni, and Zn; and ii) a second metal in a second concentration that is at least about 1 wt. %; and B) a second layer of a second alloy that is less noble than the first alloy and less noble than the substrate or the mandrel, the second alloy comprising:

i) the first metal in a third concentration that is at least about 1 wt. %; and ii) the second metal in a fourth concentration that is at least about 1 wt. %.

2. The method of claim 1, wherein the first metal is Ni or Zn.

3. The method of claim 1, wherein each layer of the series of layers is discrete.

4. The method of claim 1, further comprising a diffuse interface between each layer of the series of layers.

5. The method of claim 1, wherein the second metal is selected from Co, Fe, Ni, and Zn, the second metal being different than the first metal.

6. The method of claim 1, wherein the series of layers further comprises a third layer.

7. The method of claim 1, further comprising forming a cladding by removing the coating from the mandrel.

8. A method comprising:

forming a coating on a substrate or mandrel, the coating having a thickness from 5 microns to 50 microns and comprising a series of layers arranged in a repeating pattern, each layer of the series of layers having a thickness from about 5 nanometers to about 1,000 nanometers, the series of layers comprising:

A) a first layer of a first alloy that is more noble than the substrate or the mandrel, the first alloy comprising:

i) Co in a first concentration that is at least about 1 wt. %; and ii) Ni in a second concentration that is at least about 1 wt. %; and B) a second layer of a second alloy that is more noble than the first alloy and more noble than the substrate or the mandrel, the second alloy comprising:

i) Co in a third concentration that is at least about 1 wt. %; and ii) Ni in a fourth concentration that is at least about 1 wt. %; and C) a third metal layer of a third alloy that is more noble than the substrate or the mandrel, the third alloy comprising:

i) Co in a fifth concentration that is at least about 1 wt. %; and ii) Ni in a sixth concentration that is at least about 1 wt. %; the first, second, and third alloys being different.

9. The method of claim 8, wherein each layer of the series of layers is discrete.

10. The method of claim 8, further comprising a diffuse interface between each layer of the series of layers.

11. The method of claim 8, further comprising forming a cladding by removing the coating from the mandrel.

12. A method comprising:

forming a coating on a substrate or mandrel, the coating having a thickness from 5 microns to 50 microns and comprising a series of layers arranged in a repeating pattern, each layer of the series of layers having a thickness from about 5 nanometers to about 1,000 nanometers, the series of layers comprising:

A) a first layer of a first alloy that is more noble than the substrate or the mandrel, the first alloy comprising:

i) a first metal in a first concentration that is at least about 1 wt. %, the first metal selected from Co, Fe, Ni, and Zn; and ii) a second metal; and B) a second layer of a second alloy that is less noble than the first alloy and less noble than the substrate or the mandrel, the second alloy comprising:

i) the first metal in a second concentration that is at least about 1 wt. %; and ii) the second metal.

13. The method of claim 12, wherein the first metal is Ni or Zn.

14. The method of claim 12, wherein each layer of the series of layers is discrete.

15. The method of claim 12, wherein second metal is selected from Co, Fe, Ni, and Zn, the second metal being different than the first metal.

16. The method of claim 12, wherein the series of layers further comprises a third layer.

17. The method of claim 12, further comprising forming a cladding by removing the coating from the mandrel.

* * * * *